US005169355A

United States Patent [19]

Tammera

[11] Patent Number: 5,169,355

[45] Date of Patent: Dec. 8, 1992

[54] TOY STATION WITH SIMULATED BOARDING PASSENGERS

[76] Inventor: Robert F. Tammera, 56 Gilbert Pl., West Orange, N.J. 07052

[21] Appl. No.: 771,641

[22] Filed: Oct. 3, 1991

[51] Int. Cl.[5] ..... A63H 19/34

[52] U.S. Cl. ..... 446/358; 446/477

[58] Field of Search ..... 446/477, 476, 314, 358, 446/425, 268

[56] References Cited

U.S. PATENT DOCUMENTS

| | | | |
|---|---|---|---|
| 1,966,031 | 7/1934 | Handy | 446/358 |
| 2,138,367 | 11/1938 | Bonanno | 446/358 |
| 2,639,548 | 5/1953 | Hall | 446/477 X |
| 2,668,819 | 9/1954 | Bonanno | 446/358 |
| 2,774,181 | 12/1956 | Cowen | 446/314 |
| 2,933,854 | 4/1960 | Crosman | 446/358 |

*Primary Examiner*—Mickey Yu

[57] ABSTRACT

A number of miniature passenger figures and/or other objects are disposed along the loading platform of a toy train station awaiting arrival of a train. When the train stops at the station, a control switch is operated to swing the passengers upward to a hidden area under the station roof. When the train leaves the station, the passengers are no longer in view on the platform and appear to have boarded the train. A reverse action simulates the detraining of passengers when a train arrives at an empty platform. The passenger figures are mounted along a common base plate having a vertical lift bar connected by a linkage and slide plate mechanism to a dual coil electromagnetic drive. A controller actuates the drive and linkages to swing the plate and passengers upward through an arc to a horizontal position under the roof out of view. The controller and drive also return the passengers to the platform for the reverse sequence.

7 Claims, 4 Drawing Sheets

FIG. 2
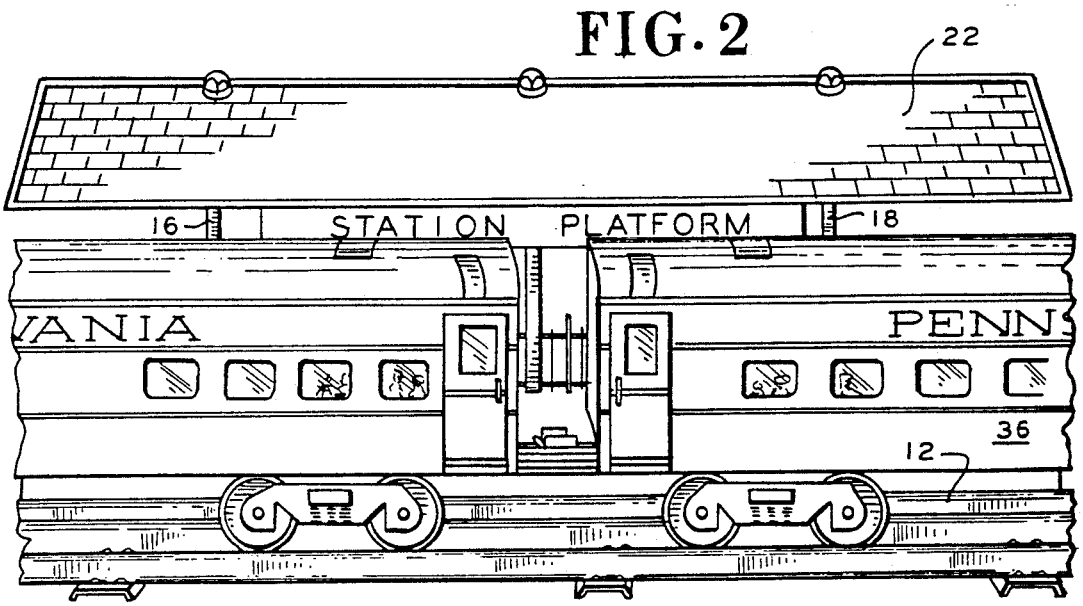
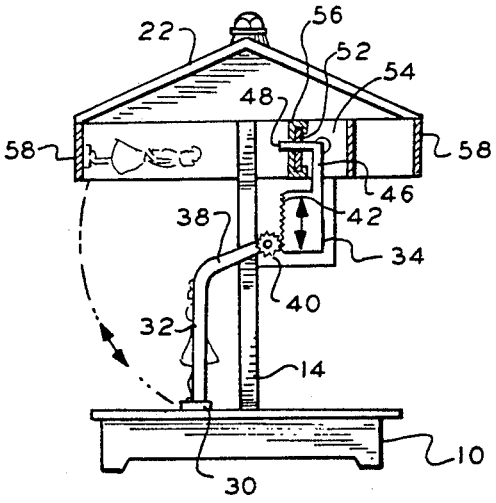
FIG. 4
FIG. 5
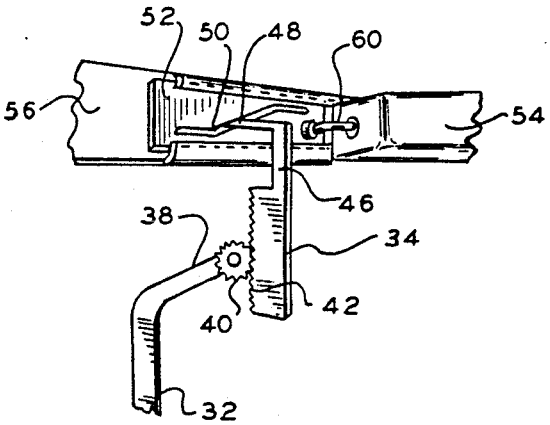

FIG. 3
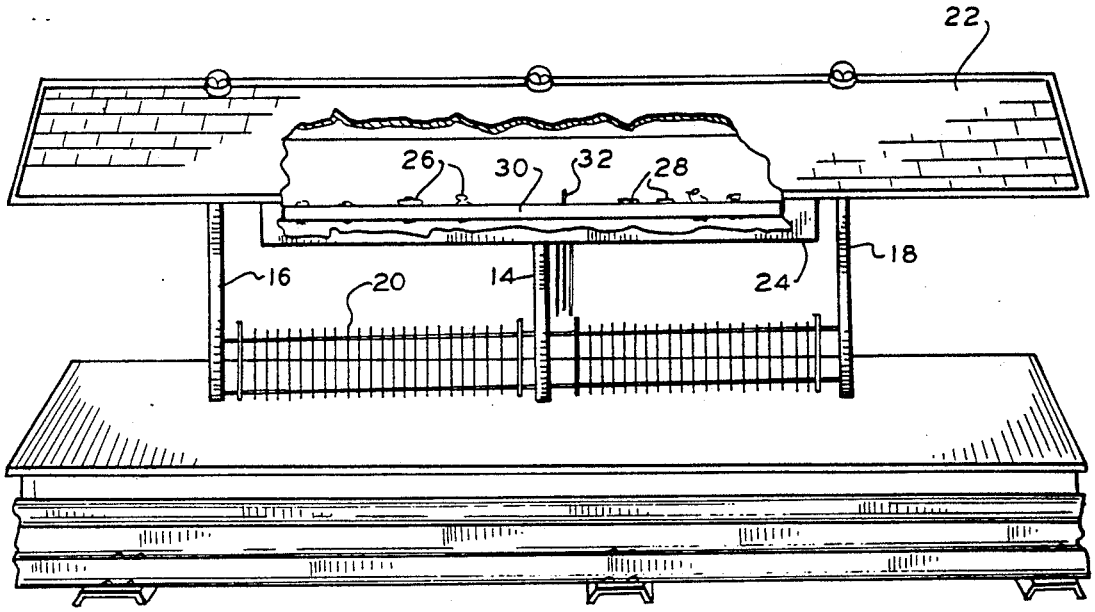
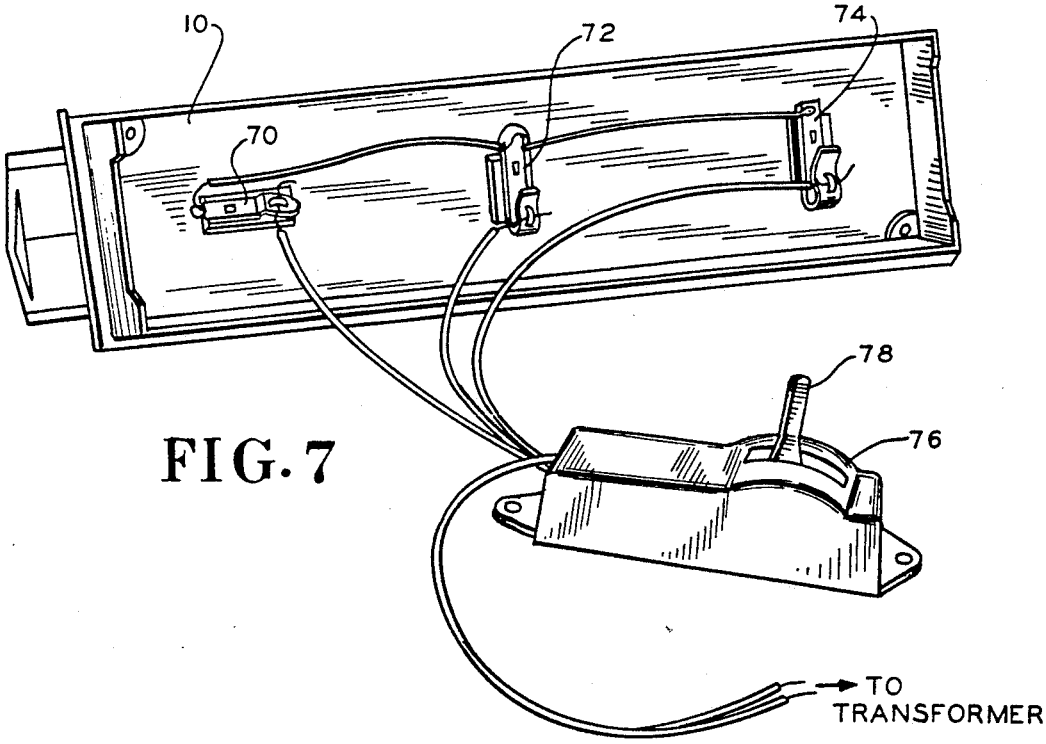
FIG. 7

TOY STATION WITH SIMULATED BOARDING PASSENGERS

BACKGROUND OF THE INVENTION

1. Field of the Invention

The present invention relates to a toy station having miniature passenger figures standing on a platform to board a train or other vehicle and particularly to a mechanism which simulates the boarding of the passengers who are removed from view when the train stops and departs, or returned to view for the reverse action.

2. Description of the Prior Art

Previous devices for moving toy figures on station platforms included the use of electromagnetic coils to control a lever or arm to open a door of a miniature housing and move a figure through the door onto the platform, such as shown in U.S. Pat. Nos. 2,138,367 and 2,688,819. A similar mechanism is shown in U.S. Pat. No. 1,966,031 wherein linkages to a magnetic solenoid cause movement of another toy figure through a door of a building on a platform and simulate a hand waving motion. Another magnetic coil arrangement controls movement of a figure up and down a stairway of a toy railway signal tower, as shown in U.S. Pat. No. 2,774,181. These devices, however, are relatively complex and do not simulate the boarding of passengers onto a train.

SUMMARY OF THE INVENTION

It is, therefore, the primary object of the present invention to provide a simplified mechanism for simulating the boarding of passengers from a toy station platform onto a toy train or other vehicle.

It is another object of the invention to provide a mechanism which removes passengers, or other items, on a toy station platform from view upon arrival of a train at the station, so that the passengers appear to have boarded the train when it leaves the station.

It is a further object of the invention to provide a mechanism which swings passengers mounted on a common base plate upwardly to a position under the station roof when a train arrives at the station to give the appearance that the passengers have boarded the train when it departs.

An additional object of the invention is to provide a dual electromechanical drive and manual control which actuate a linkage mechanism to swing the passenger from the platform through an arc to a horizontal position under the roof hidden from view and return the passengers for the reverse action.

These objects are achieved with a unique structure and mechanism including a toy station having a boarding platform and overhanging roof. Passengers and other articles are mounted on a common base plate which includes a vertical post and pinion gear. A dual coil electromagnetic solenoid is mounted under the roof and includes a plunger connected to a horizontal slide plate. A vertical slide plate includes an arm which rides in a slot in the horizontal slide plate and a rack which meshes with the pinion gear of the vertical post. Operation of a control unit in one direction actuates one coil and the plunger to move the horizontal slide plate which causes the vertical slide plate to move downwardly and engage the gear of the vertical post to swing the passenger base plate through an arc upwardly to a position under the roof. Opposite movement of the control unit actuates the second coil to cause the plunger and slide plates to reverse the movement to simulate the reappearance of the passengers on the platform.

Other objects and advantages will become apparent from the following description in conjunction with the accompanying drawings.

BRIEF DESCRIPTION OF THE DRAWINGS

The invention is illustrated in the accompanying drawings in which:

FIG. 2 is a front angular view showing a train stopped at the station.

FIG. 3 is front angular view of the station platform after the train leaves with passengers no longer on the platform and a cut away portion of the roof showing the location of the passengers.

FIG. 4 is a side view of the platform in partial section to show the mechanism for swinging the passengers under the roof.

FIG. 5 is a rear angular view showing the dual coil electromagnet and plunger, slide plate, rack and pinion and vertical arm providing the mechanism for moving the passengers out of view.

FIG. 7 is a bottom view of the platform showing electrical wire connections to the controller for energizing the dual coil electromagnet.

DESCRIPTION OF THE PREFERRED EMBODIMENT

Figure 1:
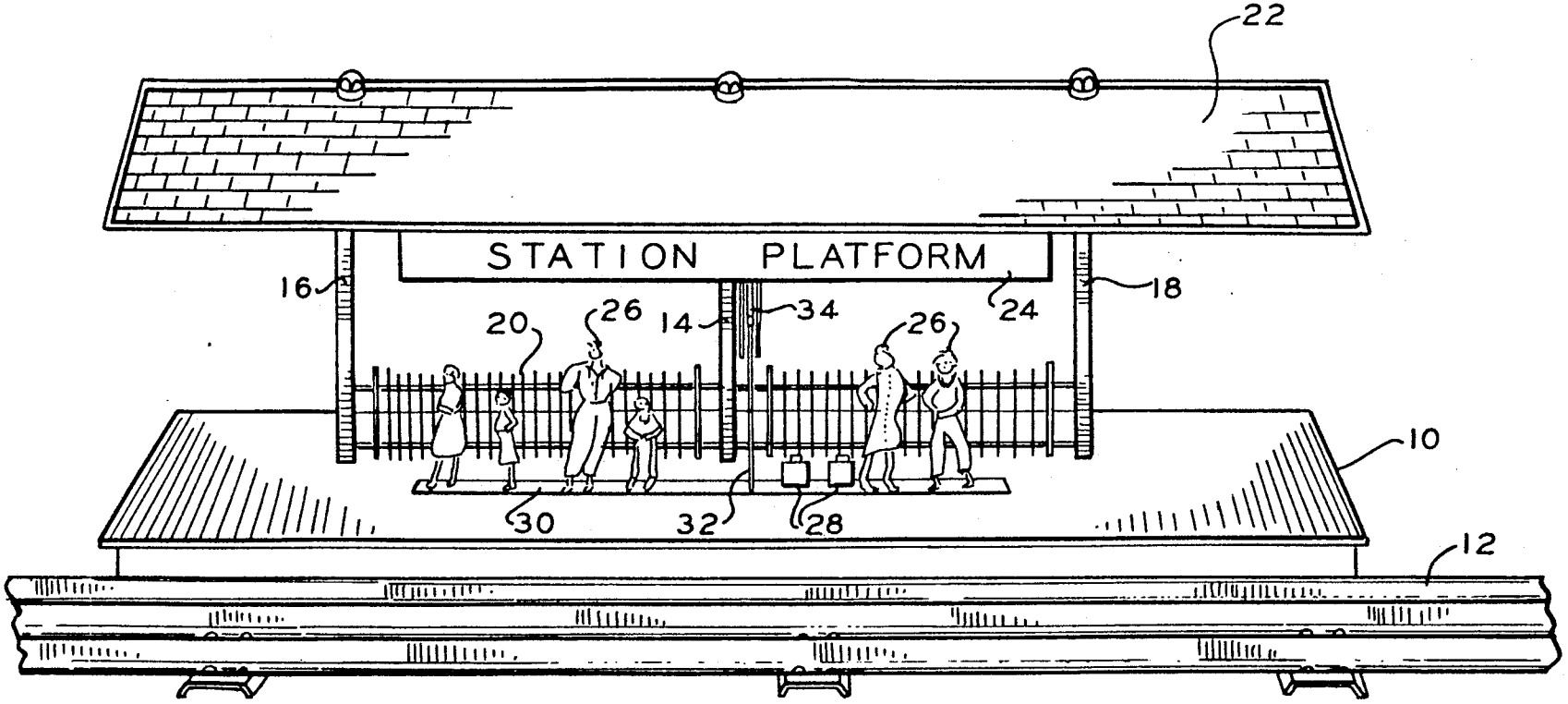
FIG. 1 is a front angular view of a toy station platform with passengers and baggage awaiting arrival of a train.

As shown in FIG. 1, a toy train station platform 10 is disposed alongside a set of tracks 12 for guiding a passenger train. Disposed on the platform are a center post 14, two end posts 16, 18, and a fence 20. Supported on the posts is an overhanging roof 22 with a station sign 24. A plurality of passenger FIGS. 26 and articles such as baggage 28 or small freight are standing on the platform awaiting arrival of a train. The passenger figures and articles are mounted on a flat horizontal bar 30 which rests on the platform. A vertical link 32 connects bar 30 to a mechanism partially shown at 34 which will be more fully described hereinafter.

FIG. 2 shows a portion of a passenger train 36 which stops at the Station to pick up the passengers. As shown in FIG. 3, when the train departs, the passengers are gone and appear to have boarded the train. In actuality, the bar 30 and link 32 have been swung upwardly under the overhang of roof 22, as shown in the cutaway portion of the roof, with the passengers mounted on the bar now out of sight.

Figure 6:
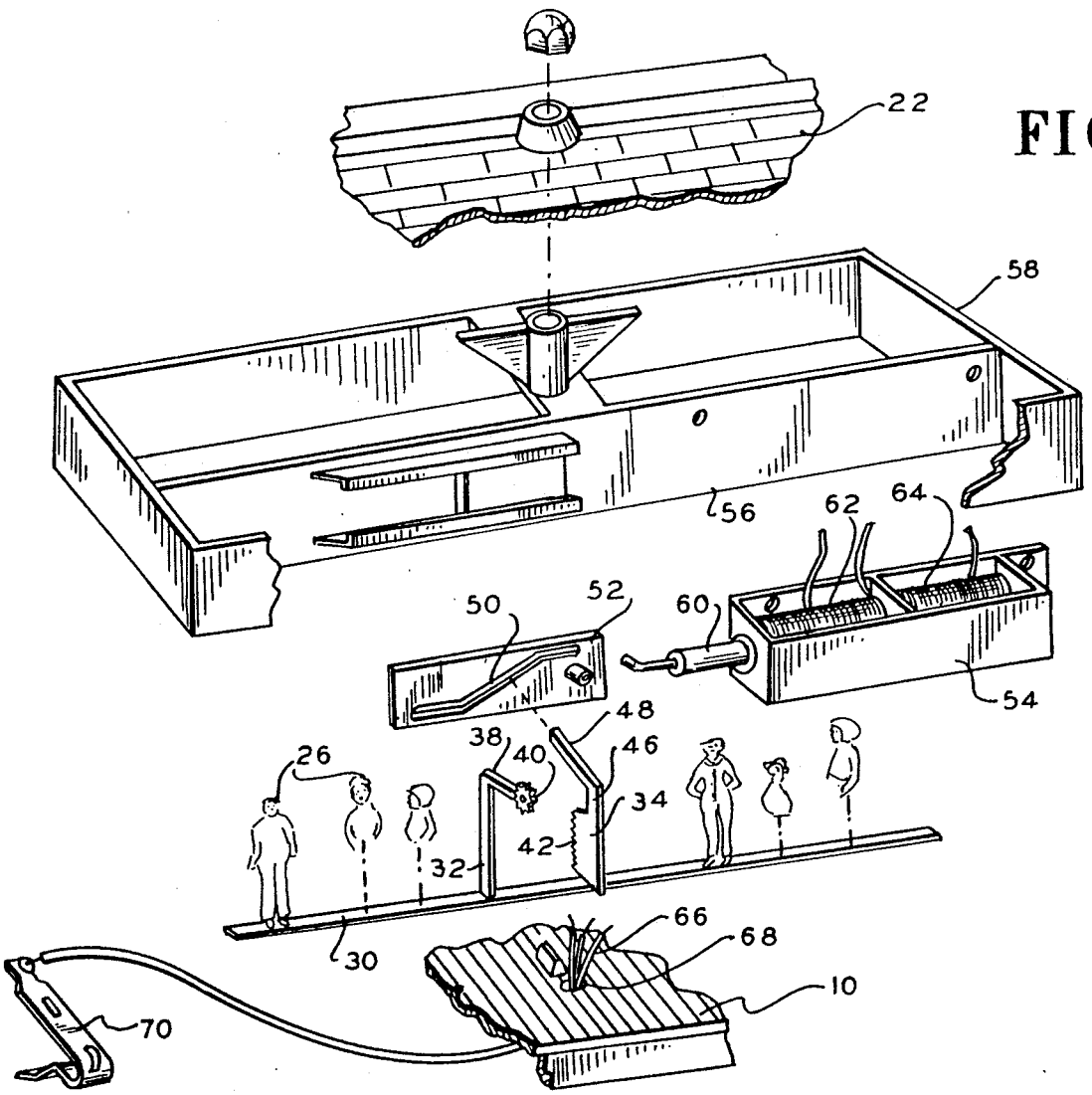
FIG. 6 is an exploded view of the various components of the platform and mechanism.

FIG. 4 is a side view of the station showing part of the mechanism for swinging the passengers up under the roof. The vertical link 32 may be secured to a passenger figure to make it less noticeable. An arm 38 extends from link 32 and includes a pinion gear 40 fixed at the end which meshes with a rack 42 on a vertical slide plate 34. Plate 34 includes a vertical extension 46 and a horizontal extension 48 as shown in further detail in FIG. 5. Extension 48 fits through a sloping slot 50 in a horizontal slide plate 52. A dual electromagnetic coil 54 is mounted on a cross member 56 of a roof supporting skirt 58, as shown in FIG. 6 in an exploded view of the various elements. Coil 54 includes a plunger 60 connected to horizontal slide plate 52 and movable within dual direction coils 62, 64. The coils are connected by wires 66 extending along posts 14, 16 and 18 through holes 68 in the platform to terminal clips 70, 72, 74, on the underside of the platform 10 as shown in FIG. 7. The wires are also connected to a controller unit 76 and to a transformer and power source, not shown. The controller is a standard device which connects power to either of coils 62 or 64 by manual movement of handle 78 in one direction or the other.

In operation, the passengers 26 are seen on platform 10 awaiting arrival of a train. When the train 36 stops at the station, the passengers are blocked from view. At this time, the controller handle 78 is moved in one direction to activate one of the coils 62 to move plunger 60 inwardly and move slide plate 52 to the right. This causes extension 48 to slide downwardly along slot 50 while extension 46 and slide plate 34 also moved downwardly. Rack 42 thus moves down as it meshes with pinion 40 which is caused to rotate clockwise and also rotate arm 38 and link 32 to swing bar 30 and the passengers upwardly through an arc of about 115° to a position under the roof behind skirt 58. When the train leaves the station, the passengers and articles are no longer in view and appear to have boarded the train.

The passengers are held in the upward position by the mechanism until it is desired to reverse the sequence. When a train arrives at the station at a later time, the controller handle is moved in the opposite direction, activating the other coil 64 which moves plunger 60 outwardly, causing plate 52 to move to the left. Extension 48 then moves up along slot 50 with extension 46, plate 34 and rack 42 also moving upwardly, while pinion 40 is rotated counterclockwise. Arm 38, link 32 and bar 30 then swing downwardly back to the platform with the passengers thus reappearing. When the train leaves, this time the passengers are again in view of the platform and appear to have just arrived from the train.

While the illustrated embodiment shows the unique mechanism utilized in connection with a toy train station, a like mechanism may be used with a bus station. Other mechanisms for swinging the passengers out of view may also be employed, such as a miniature electric motor and gear drive to move a link and arm assembly. Other variations may likewise be made in the particular configurations without departing from the scope of the invention as set forth in the appended claims.

What is claimed is:

1. A toy passenger station comprising:

a loading platform positioned alongside the path of a toy transit vehicle;

a roof overhanging a portion of said platform and supported on a plurality of posts mounted on said platform;

a plurality of passenger figures disposed along said platform;

a horizontal bar supporting said figures along said platform;

electromechanical drive means mounted under said roof and being operable in two directions; linkage means connecting said horizontal bar to said drive means; and control means connected to a source of power for selectively actuating said drive means in either of said directions, said control means causing said drive means to move said linkage means, horizontal bar and passenger figures to swing up under said roof out of view in one direction and causing said drive means to move said linkage means, horizontal bar and passenger figures to swing down from said roof onto said platform in the other direction, said control means being actuable when said transit vehicle is alongside said platform to block the view of said passenger figures, so that said passenger figures are out of view when said vehicle leaves and appear to have boarded said vehicle, and are selectively brought into view on the platform to appear to have arrived from said vehicle.

2. The device of claim 1 wherein said electromechanical drive means is a dual coil electromagnetic solenoid including a plunger operable in two directions.

3. The device of claim 2 wherein said linkage means includes a vertical link connected to said horizontal bar, an arm and pinion gear connected to said vertical link, a vertical slide plate including a rack engaging said pinion gear and vertical and horizontal extensions, a horizontal slide plate mounted adjacent said electromagnetic solenoid and connected to said plunger and having a slot therein to receive said horizontal extension of said vertical slide plate, said slot having upper and lower portions and a sloping portion therebetween, actuation of said drive means in one direction causing said plunger to move said horizontal slide plate in one horizontal direction and said vertical slide plate to move in one vertical direction along with said rack and pinion gear and swing said arm and vertical link and horizontal bar in one direction, and actuation in the other direction causing a reverse movement.

4. The device of claim 3 wherein said station is a toy train station having tracks alongside said loading platform and said vehicle is a toy train running on said tracks, said roof including a skirt, said passengers being selectively swung up under said roof behind said skirt to be hidden from view.

5. The device of claim 4 wherein said control means is a controller having a manually operable lever moveable in either direction to selectively connect power to either of said coils.

6. The device of claim 5 wherein said platform includes terminal connections between said controller and terminal connections, said wire connections extending through said platform along said posts to said electromagnetic coils to supply power thereto.

7. A toy station comprising:

a loading platform positioned alongside the path of a toy transit vehicle;

a roof overhanging a portion of said platform and supported on a plurality of posts mounted on said platform;

a plurality of articles disposed along said platform:

a horizontal bar supporting said articles along said platform;

electromechanical drive means mounted under said roof and being operable in two directions;

linkage means connecting said horizontal bar to said drive means; and control means connected to a source of power for selectively actuating said drive means in either of said directions, said control means causing said drive means to move said linkage means, horizontal bar and articles to swing up under said roof out of view in one direction and causing said drive means to move said linkage means, horizontal bar and articles to swing down from said roof onto said platform in the other direction, said control means being actuable when said transit vehicle is alongside said platform to block the view of said articles, so that said articles are out of view when said vehicle leaves and appear to have been loaded on said vehicle, and are selectively brought into view on the platform to appear to have been unloaded from said vehicle.

* * * * *